United States Patent [19]
Macarle, Jr.
[11] 4,318,238
[45] Mar. 9, 1982

[54] REVERSIBLE, PORTABLE DIRECTION SIGN

[76] Inventor: Anthony J. Macarle, Jr., 4008 N. 59th Ave., Phoenix, Ariz. 85063

[21] Appl. No.: 120,254

[22] Filed: Feb. 11, 1980

[51] Int. Cl.[3] ..... G09F 15/00; G09F 7/00
[52] U.S. Cl. ..... 40/607; 40/612; 40/486; 40/492; 116/63 P
[58] Field of Search ..... 40/492, 486, 607, 488, 40/606, 612, 610, 495, 588, 534, 536; 116/294, 63 P, 63 R

[56] References Cited

U.S. PATENT DOCUMENTS

| | | | |
|---|---|---|---|
| 737,860 | 9/1903 | Nifong | 40/488 |
| 889,590 | 6/1908 | Dun-Lany | 40/486 |
| 1,174,360 | 3/1916 | Shindel | 40/607 |
| 2,528,962 | 11/1950 | Lieutard | 40/612 |
| 2,628,587 | 2/1953 | Peters et al. | 116/63 P |
| 2,782,745 | 2/1957 | Paschke | 40/610 |
| 3,139,611 | 6/1964 | Fleming | 40/492 |
| 4,019,271 | 4/1977 | Latimer | 40/607 |
| 4,176,484 | 12/1979 | Terris | 40/612 |
| 4,176,485 | 12/1979 | Terris | 40/612 |
| 4,217,713 | 8/1980 | Greenberger | 40/488 |

*Primary Examiner*—Gene Mancene
*Assistant Examiner*—Michael J. Foycik
*Attorney, Agent, or Firm*—Cahill, Sutton & Thomas

[57] ABSTRACT

A reversible, portable direction indicating sign for use in road construction and maintenance work includes an upper indicia bearing panel rigidly attached to and spaced from an upright member and a lower indicia bearing panel rotatably mounted on the upright member. The lower indicia bearing panel includes an arrow imprinted thereon which can be pointed to the right or to the left by rotating the second indicia bearing panel. The word "KEEP" is printed on the upper indicia bearing panel. The word "LEFT" is printed on the lower indicia bearing panel beneath the arrow when the arrow points to the left. The word "RIGHT" is printed on the lower indicia bearing panel beneath the arrow when the arrow points to the right. When the arrow points to the right the portion of the lower indicia bearing panel on which the inverted word "LEFT" is imprinted in located in the space between the upright member and the upper indicia bearing member, so that the word "LEFT" is covered thereby. Similarly, the inverted word "RIGHT" is covered when the arrow is pointed to the left.

7 Claims, 5 Drawing Figures

REVERSIBLE, PORTABLE DIRECTION SIGN

BACKGROUND OF THE INVENTION

1. Field of the Invention

The invention relates to portable traffic signs, and more particularly to portable traffic signs capable of being adjusted to indicate different directions in which traffic is to be directed.

2. Description of the Prior Art

During road construction work and road repair work, it is frequently necessary for construction workers to detour traffic and/or to guide traffic into a particular lane. Frequently, flagmen are employed to direct traffic into a particular path of travel. This approach is sometimes wasteful of human labor and hence unnecessarily expensive. Further, it is completely unsatisfactory for guiding and directing traffic at night after a construction crew leaves the construction site. Frequently, portable signs are utilized. Some such signs include a base, an upright, and a sign having an arrow pointing to the left and having the words "KEEP LEFT" thereon for directing traffic into a travel path located to the left of the sign. Similarly, other signs having an arrow pointing to the right and having the words "KEEP RIGHT" thereon are utilized to direct traffic into a travel path located to the right of the sign. While such signs are capable of functioning perfectly satisfactorily, it is necessary to manufacture, store and transport a large number of both left and right indicating direction signs. Thus, there is presently an unmet need for a single direction indicating sign which is inexpensive and reliable and is capable of directing traffic to the right or left in order to reduce the cost associated with making, storing and transporting both kinds of direction indicating signs.

Accordingly, it is an object of the invention to provide an inexpensive, reliable, portable traffic sign capable of directing traffic either to the right or left of the sign.

A novelty search directed to the present invention uncovered U.S. Pat. Nos. 1,443,247; 1,174,360; 2,613,463; 2,132,478; 2,624,307; 2,667,000; 3,621,807; 3,917,231; 4,050,401; 4,134,643 and U.S. Pat. No. 29,566. Although the foregoing patents disclose a variety of portable signs, none meet the needs set forth above.

Another approach to directing traffic to the right or the left in road construction areas involves utilization of large electrical devices having flashing lights which are programmed to produce or outline a large flashing arrow pointing to the right or left, depending on the direction in which it is desired to direct traffic. Such devices are large and expensive, and are unsuitable wherein is desirable to have a large number of spaced traffic signs indicating to traffic that it should keep right or keep left.

Accordingly, it is another object of the invention to provide a portable traffic sign which overcomes the above mentioned shortcomings of the prior art.

SUMMARY OF THE INVENTION

Briefly described, and in accordance with one embodiment thereof, the invention provides a portable traffic direction sign including a base and a rigid post attached to the base. At the top of the post, a rectangular upper indicia bearing panel is rigidly attached to the post, a spacer being disposed between the upper portion of the post and the upper portion of the upper indicia bearing panel. A first word is printed on the first indicia bearing plate. A lower indicia bearing plate is rotatably mounted on the post beneath the first indicia bearing panel, an upper portion of the second indicia bearing panel being disposed between the lower portion of the upper indicia bearing panel and the post. A second word is printed adjacent to the bottom of the lower indicia bearing panel, and a third word inverted with respect to the second word is printed on the upper part of the lower indicia bearing panel and is covered by the lower portion of the lower indicia bearing panel. A hole through the post is aligned with a first hole in the lower indicia bearing panel and a second hole in the upper indicia bearing panel. A locking pin is inserted through the aligned holes to lock the lower indicia bearing panel in fixed relationship to the upper indicia bearing panel so that the visible words display a first message. If the locking pin is removed, the lower indicia bearing panel can be rotated to align a third hole therein with a hole in the post and the first hole. The locking pin then can be inserted to lock the lower indicia bearing plate in alignment with the upper indicia bearing panel. A second message is then displayed by the portable sign. In the described embodiment of the invention, the word printed on the upper indicia bearing panel. A second message is then displayed by the portable sign. In the described embodiment of the invention, the word printed on the upper indicia bearing plate is the word "KEEP". One of the words imprinted on the lower rotatable indicia bearing panel is the word "RIGHT" and the second word imprinted on the lower indicia bearing panel is the word "LEFT", which is inverted with respect to the word "RIGHT". An arrow is disposed on the lower indicia bering panel at the center thereof, and points to the left when the word "LEFT" is at the bottom of the lower indicia bearing panel and points to the right when the word "RIGHT" is at the bottom of the second indicia bearing panel.

DESCRIPTION OF THE INVENTION

Figure 1:
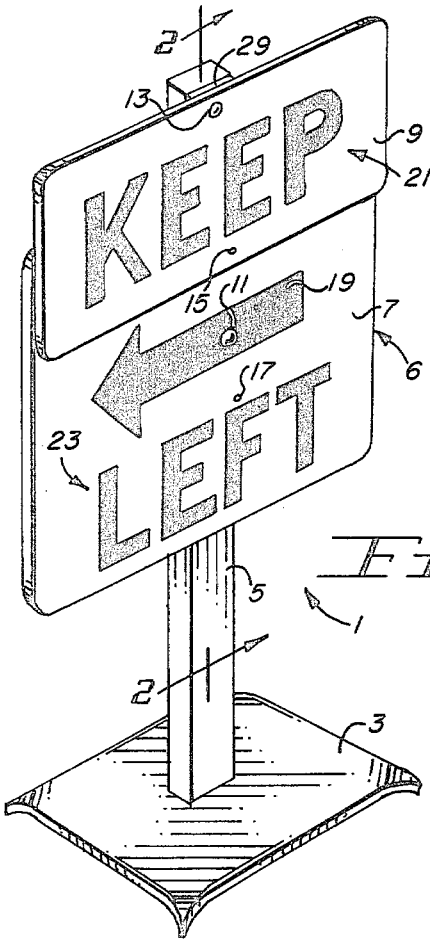
FIG. 1 is a perspective view of the portable traffic sign of the present invention.

Referring now to the drawings, and particularly to FIG. 1 portable traffic sign 1 includes a large base 3 for supporting portable sign 1 on the ground. Base 3 needs to be sufficiently large, and in some cases sufficiently heavy to ensure that portable sign 1 remains upright in the presence of wind gusts. Base 3 can be made of steel.

Vertical post 5 is rigidly attached to the central portion of the upper surface of base 3. Base 5 can be made of steel, and is welded to base 3.

A sign portion 6 of portable sign 1 includes a rotatable indicia bearing plate or panel 7 and an upper fixed indicia bearing plate or panel 9.

Figure 2:
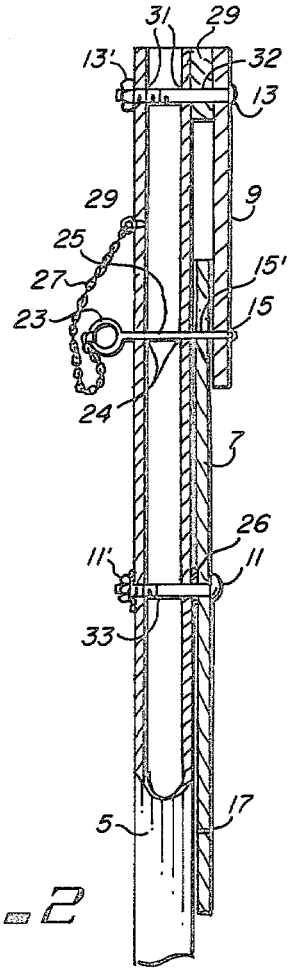
FIG. 2 is a partial section view taken along section line 2 of FIG. 1.

Upper indicia bearing panel 9 has the word "KEEP" printed on the front surface thereof, as indicated by reference numeral 21. Upper indicia bearing panel 9 is rigidly attached to the upper portion of vertical post 5 by means of bolt 13 and nut 13', as best seen in FIG. 2. Spacer 29 is disposed between the upper portion of indicia bearing plate 9 and post 5, and bolt 13 extends through hole 32 in spacer 29 and hole 31 in post 5. The opposite faces of spacer 29 are parallel, so that upper indicia bearing panel 9 is parallel to and spaced from the front surface of post 5 by a distance equal to the thickness of spacer 29.

As shown in FIG. 2, post 5 can be hollow in order to reduce the weight and cost of portable traffic sign.

Lower indicia bearing panel 7 is rotatably attached to post 5 by means of bolt 11 and a nut 11', as best seen in FIG. 2. A washer 26 is disposed between lower indicia bearing panel 7 and front surface of vertical post 5, enabling lower indicia bearing panel 7 to be rotated without excessive binding with or friction against vertical post 5.

Upper indicia bearing panel 9 has a hole 15 aligned with the longitudinal axis of vertical post 5. Lower indicia bearing panel 7 has two holes 15' and 17 which may be aligned with the longitudinal axis of vertical post 5, and each may be aligned with hole 15 of upper indicia bearing panel 9 by appropriately rotating lower indicia bearing panel 7. The hole or pair of holes 24 through vertical post 5 can be aligned with hole 15 of upper indicia bearing panel 9 and either hole 15' or hole 17 of lower indicia bearing panel 7.

Figure 3A:
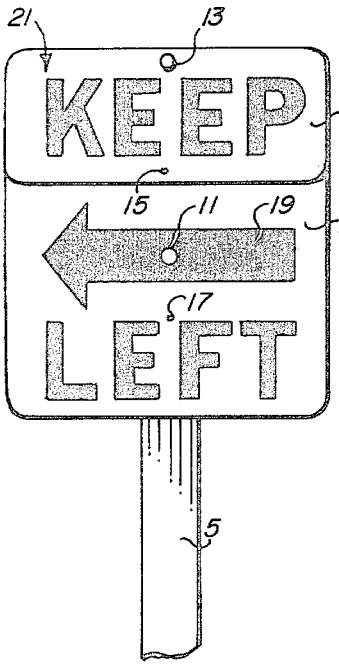
FIG. 3A is a partial front view useful in describing the operation of the sign of FIG. 1.
Figure 3B:
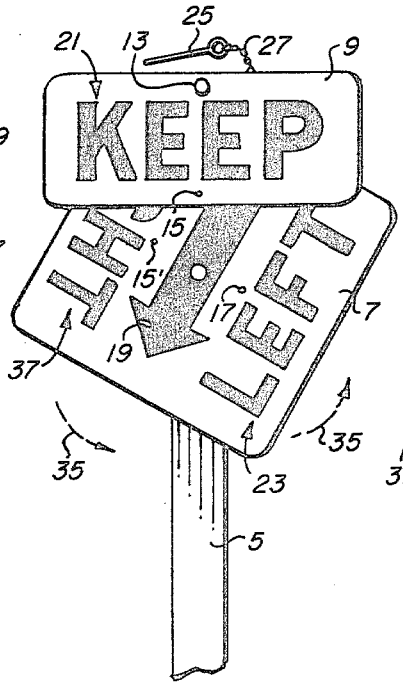
FIG. 3B is a partial front view useful in describing the operation of the sign of FIG. 1.
Figure 3C:
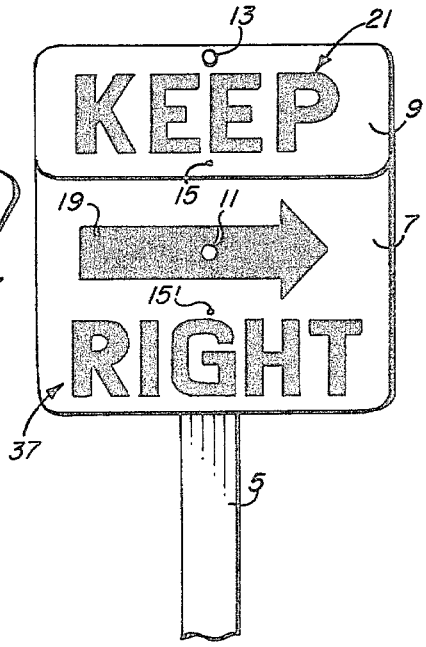
FIG. 3 is a partial front view useful in describing the operation of the sign of FIG. 1.

A locking pin 25 can be inserted through holes 24, 15, and either 15' or 17 (depending upon whether lower indicia bearing panel 7 is in a configuration shown in FIGS. 1 and 3A or is in configuration shown in FIG. 3C) to lock lower indicia bearing panel 7 with respect to upper indicia bearing panel 9. Locking pin 25 has a loop 25, which is connected by means of chain 27 and hook 29 to the rear face of vertical post 5 to avoid inadvertent misplacement of locking pin 25.

As can be readily seen from the drawings, lower indicia bearing panel 7 has an arrow 19 centrally disposed thereon. Lower indicia bearing panel 7 also has the word "LEFT", (indicated by reference numeral 23) disposed immediately beneath arrow 19 when arrow 19 points to the left as viewed from the front of portable traffic sign 1.

As seen in FIG. 3C, when lower indicia bearing panel 7 is rotated so that arrow 19 points to the right, the word "RIGHT" is disposed immediately beneath arrow 19.

As can also be seen from FIGS. 3A, 3B, and 3C, the words "RIGHT" and "LEFT" on indicia bearing panel 7 are disposed vertically with respect to each other. As best seen in FIG. 2, the lower portion of upper indicia bearing panel 9 overlaps and covers the upper portion of lower indicia bearing panel 7 so that in FIG. 3A the inverted word "RIGHT" is completely covered by upper indicia bearing panel 9. Conversely, as best seen in FIG. 3C, when arrow 19 points to the right, the inverted word "LEFT" is completely covered by the lower portion of upper indicia bearing panel 9.

FIG. 3B illustrates the relationship of upper indicia bearing panel 9 and lower indicia bearing panel 7 as lower indicia bearing panel 7 is being rotated in the direction indicated by arrow 35 to reverse the direction indicated by portable sign 1.

It should be appreciated that the thickness of spacer 29 (FIG. 2) is such that lower indicia bearing panel 7 does not rub against the under side of upper indicia bearing panel 9 when lower indicia bearing panel 7 is rotated. This prevents scratching of the various indicia on lower indicia bearing panel 7.

Use of the above described portable traffic sign reduces by one half the number of portable traffic signs which must be purchased, stored, transported to construction sites, and maintained by a road construction organization.

While the invention has been described with reference to a particular embodiment thereof, those skilled in the art will be able to make various modifications to the disclosed embodiment of the invention without departing from the true spirit and scope thereof as set forth in the appended claims. For example, other words than those illustrated could be used. As an example, the word "KEEP" could be replaced by the word "TURN" in some instances.

I claim:

1. A portable traffic sign comprising in combination:

a base member;

an upright member attached rigidly to said base member;

a first indicia bearing panel rotatably attached to said upright member;

means for pivotally attaching said first indicia bearing panel to said upright member; and a second indicia bearing panel attached in fixed relationship to said upright;

spacer means for supporting a portion of said second indicia bearing panel a predetermined distance from said upright, said first indicia bearing panel being located so that a first portion of said second indicia bearing panel covers part of said first indicia bearing panel, said second indicia bearing panel having a first word disposed on the front surface thereof, said first indicia bearing panel having a second word and a third word disposed on a front surface thereof, said second and third words being inverted with respect to each other, said first indicia bearing panel including an arrow imprinted thereon, said arrow being disposed between said second and third words, said arrow being substantially parallel to said second and third words, said second word being covered by said first portion of said second indicia bearing panel when said third word is substantially horizontal and is located adjacent to a bottom edge of said first indicia bearing panel, said arrow being completely exposed when said third word is substantially horizontal and is locatad adjacent to a bottom edge of said first indicia bearing panel, said third word being covered by said first portion of said second indicia bearing panel when said second word is substantially horizontal and is located adjacent to a bottom edge of said first indicia bearing panel, said arrow being completely exposed when said second word is substantially horizontal and is located adjacent to a bottom edge of said first indicia bearing panel, wherein said second word and said first word together convey a message to direct traffic to the right of said portable traffic sign and said third word and said first word together convey a message to direct traffic to the left of said portable traffic sign.

2. The portable traffic sign of claim 1 further including locking means for locking said first indicia bearing panel into either of two fixed configurations, said second word being horizontal and exposed and said third word being covered by said second indicia bearing panel when said first indicia bearing panel is locked into one of said configurations, said third word being exposed and horizontal and said second word being covered by said second indicia bearing panel when said first indicia bearing panel is locked into the other of said configurations.

3. The portable traffic sign of claim 2 wherein said locking means includes a locking pin, said base member having a first hole therein for receiving said locking pin, said first indicia bearing panel having second and third holes therein for receiving said locking pins, said first hole being aligned with said second hole when said first indicia bearing panel is locked into said first configuration, said first hole being aligned with said third hole in said first indicia bearing panel is locked in said second configuration.

4. The portable traffic sign of claim 1 wherein said first indicia bearing panel is substantially rectangular.

5. The portable traffic sign of claim 4 wherein said pivotal attaching means is located substantially centrally disposed in said first indicia bearing panel.

6. The portable traffic sign of claim 5 wherein said base member, said upright member, and said first and second indicia bearing panels are all composed of metal.

7. The portable traffic sign of claim 6 wherein said upright member includes a single vertical post welded to said base member.

* * * * *